US007070456B1

(12) United States Patent
Peng et al.

(10) Patent No.: US 7,070,456 B1
(45) Date of Patent: Jul. 4, 2006

(54) BATTERY CONNECTOR

(75) Inventors: Bin Peng, Kunsan (CN); Guang-Ming Zhao, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/168,597

(22) Filed: Jun. 27, 2005

(30) Foreign Application Priority Data

Dec. 14, 2004 (CN) ..... 2004 2 0054465 U

(51) Int. Cl.
*H01R 13/10* (2006.01)

(52) U.S. Cl. ..... 439/682; 439/224; 439/733.1; 439/857

(58) Field of Classification Search ..... 439/65, 439/83, 224, 500, 660, 682, 733.1, 856, 857, 439/862
See application file for complete search history.

(56) References Cited

U.S. PATENT DOCUMENTS

| | | | | |
|---|---|---|---|---|
| 5,551,883 | A | 9/1996 | Davis | |
| 5,582,519 | A | 12/1996 | Buchter | |
| 5,951,331 | A | 9/1999 | Li-Ming et al. | |
| 6,171,126 | B1 * | 1/2001 | Wu et al. | 439/224 |
| 6,551,143 | B1 | 4/2003 | Tanak et al. | |
| 6,875,049 | B1 * | 4/2005 | Kyowski et al. | 439/500 |
| 2001/0034163 | A1 * | 10/2001 | Chiang | 439/660 |

* cited by examiner

*Primary Examiner*—James R. Harvey
(74) *Attorney, Agent, or Firm*—Wei Te Chung

(57) ABSTRACT

This invention is related to a battery connector. The battery connector has an insulative housing (1) defining a plurality of cavities (11) for receiving a corresponding number of contacts (2). The contact has a flat-plate mounting base (21) engaged with the insulative housing, a resilient section (23) extending obliquely and upwardly from the flat-plate base, a flat-plate contacting section (24) extending from the resilient section and parallel to the base, a curved guiding lip (241) extending from the contacting section, and a tail section (22) extending downwardly from the mounting base to mount to a circuit board.

10 Claims, 6 Drawing Sheets

BATTERY CONNECTOR

BACKGROUND OF THE INVENTION

1. Field of the Invention

The present invention relates to a battery connector, more particularly to a battery connector having large engagement area.

2. Description of Related Art

A battery connector, such as U.S. Pat. No. 5,551,883, wherein the battery connector has an insulative housing defining a plurality of contact receiving cavities for receiving a corresponding number of contacts therein. Each contact comprises a contact portion to connect with a mating contact. A tip of the contact portion is tucked inside a channel of the insulative housing to protect the tip from damage. However, an engagement area of the contact portion for the mating contact is small, and a retention force of the contact for the mating contact is insufficient. If used such battery connector in a shocked machine, the contact is easy moved away from the mating contact and losses an electrical connection with the mating contact. Furthermore, if enlarging the size of the engagement area of the contact, the size of the contact will be enlarged correspondingly. As a result of that, the mating battery connector is difficult to insert into the battery connector along an exact direction, and is difficult to avoid being damaged.

Hence, an improved battery connector is desired to overcome the disadvantages and problems of the prior art.

SUMMARY OF THE INVENTION

Accordingly, it is an object of the present invention to provide battery connector having large engagement area with a complementary connector.

Another object of the present invention is to provide an battery connector providing high retention force to a complementary connector.

In order to achieve the above mentioned objects, a battery connector has an insulative housing received a plurality of contacts therein. The insulative housing extends lengthwise, and defines a plurality of contact receiving cavities. The cavities are at a specific pitch along the length of the insulative housing, and opening toward to a side, top and bottom face of the insulative housing for inserting into a complementary connector from the top and side face. The contacts are positioned and retained in the corresponding cavities of the insulative housing. Each contact is stamped by a metal piece, and comprises a flat-plate mounting base engaged with the insulative housing, a resilient section extending obliquely and upwardly from the flat-plate base, a flat-plate contacting section extending from the resilient section and parallel to the base. The plate-shaped contact section can provide a large plate engagement area to a mating contact of the complementary connector, and is exposed in the first portion of the cavity for mating with the mating contact. Furthermore, the contact section can provide a sufficient retention force to the mating contact by the large plate engagement area thereof. A curved guiding lip extends from the contacting section. And a tail section extends downwardly from the mounting base to mount to a circuit board. The resilient section defined at least one inner opening therein to adapt the elastic of the resilient section.

Other objects, advantages and novel features of the invention will become more apparent from the following detailed description of the present embodiment when taken in conjunction with the accompanying drawings.

DETAILED DESCRIPTION OF THE INVENTION

Figure 1:
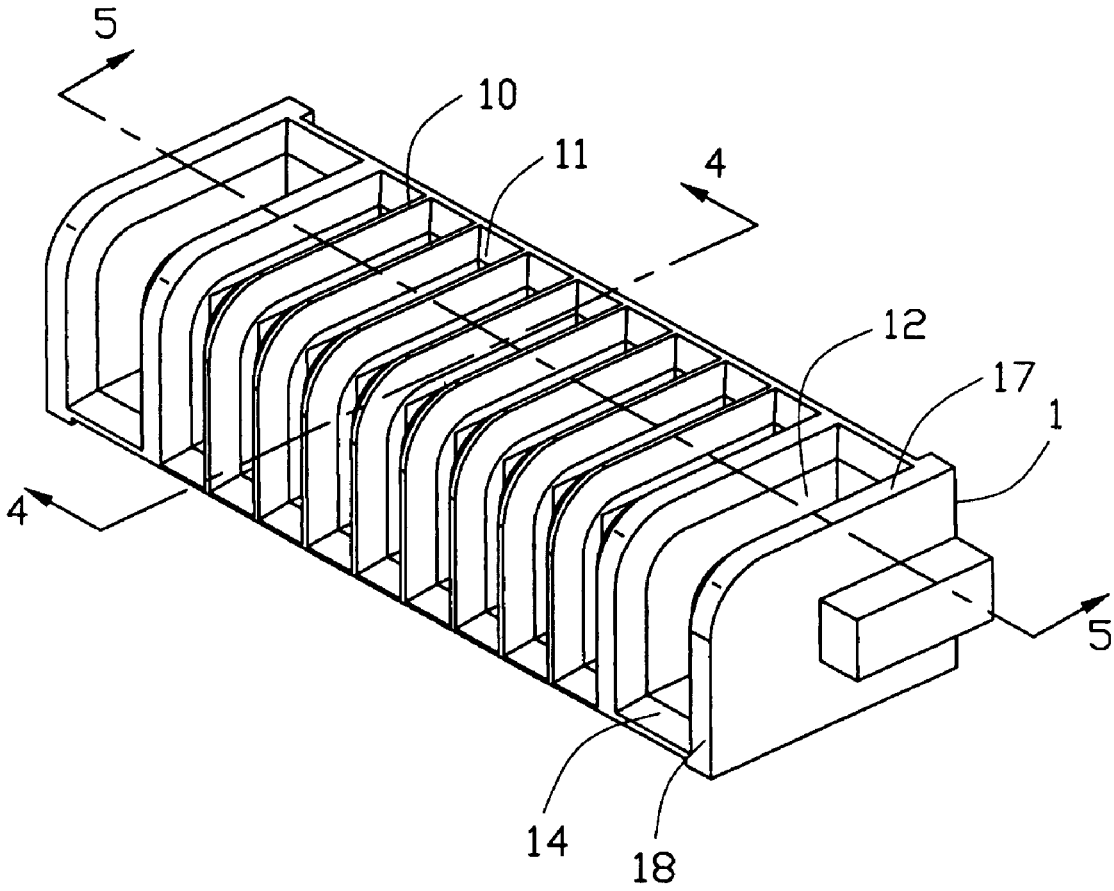
FIG. 1 is an prospective front view of a battery connector according to the present invention.

Reference will now be made to the drawing figures to describe the present invention in detail.

Figure 2:
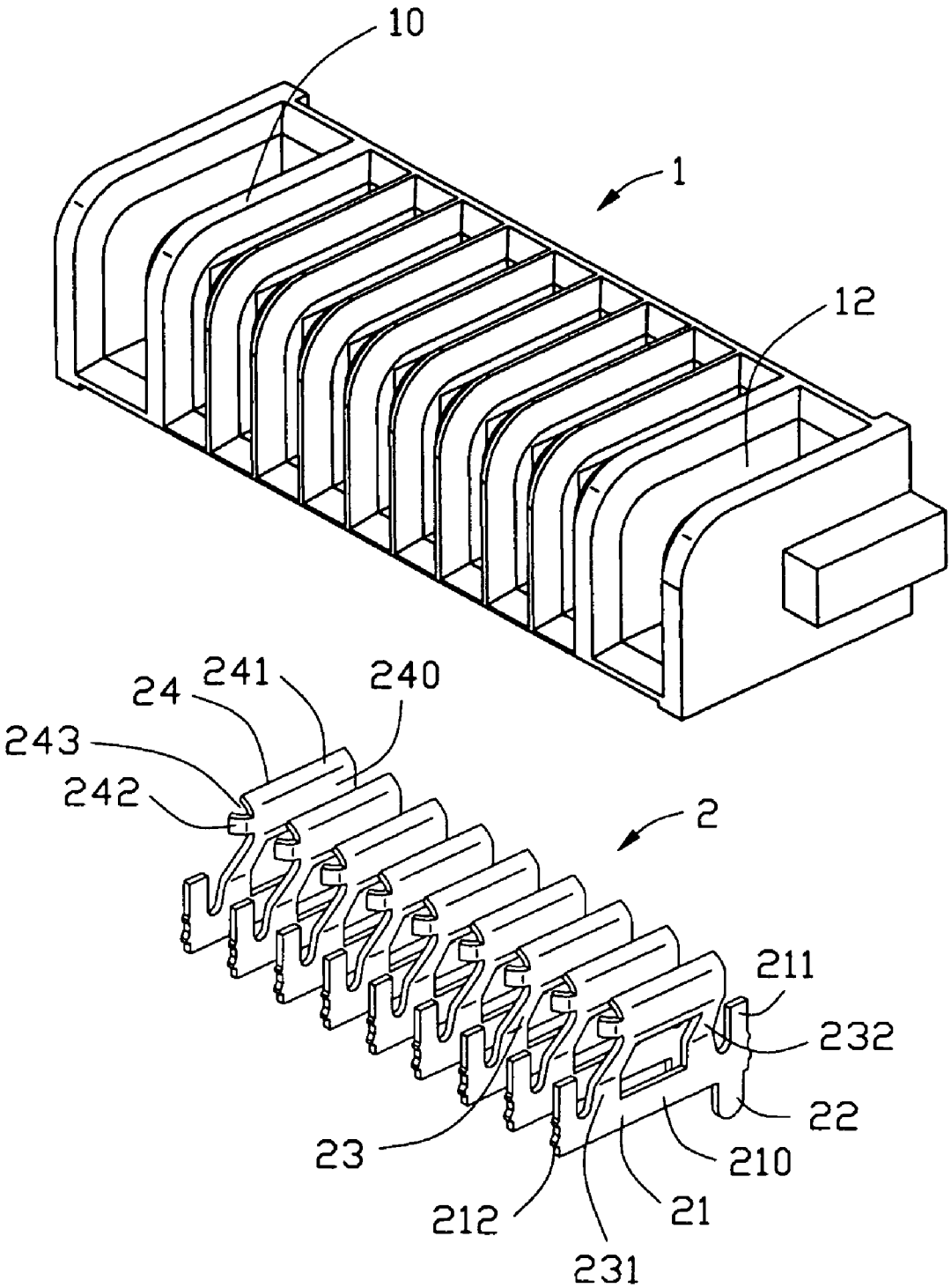
FIG. 2 is an exploded, perspective and front view of the battery connector in accordance with the present invention.

As shown in FIGS. 1 and 2, a battery connector to use in a package, comprises an insulative housing 1 and a plurality of contacts 2 received in the insulative housing 1.

With reference to FIG. 1, the insulative housing 1 has a substantially rectangular shape extending lengthwise and is formed by molding an insulative material. A plurality of contact accommodating cavities 11 are defined at a specified pitch along the length of the insulative housing 1. And a plurality of spacer 10 are formed between each two adjacent cavities 11. A pair of openings 12 are defined in two opposite ends of the insultive housing 1 for positioning a complementary connector. The cavities accommodate the contacts 2.

Figure 5:
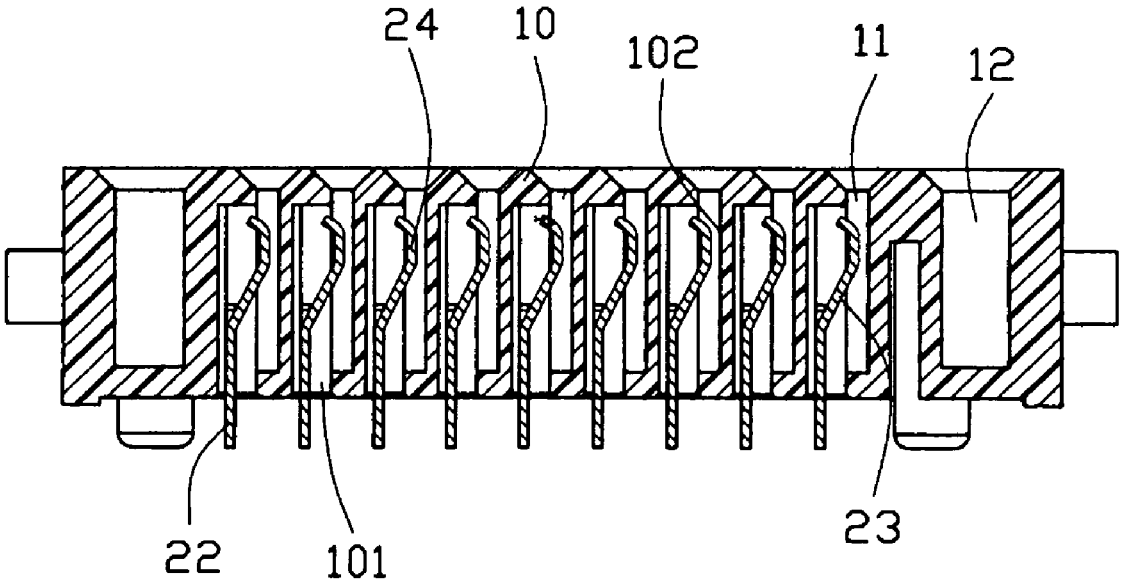
FIG. 5 is a cross-sectional view of the battery connector taken along line 5—5 of FIG. 1.
Figure 6:
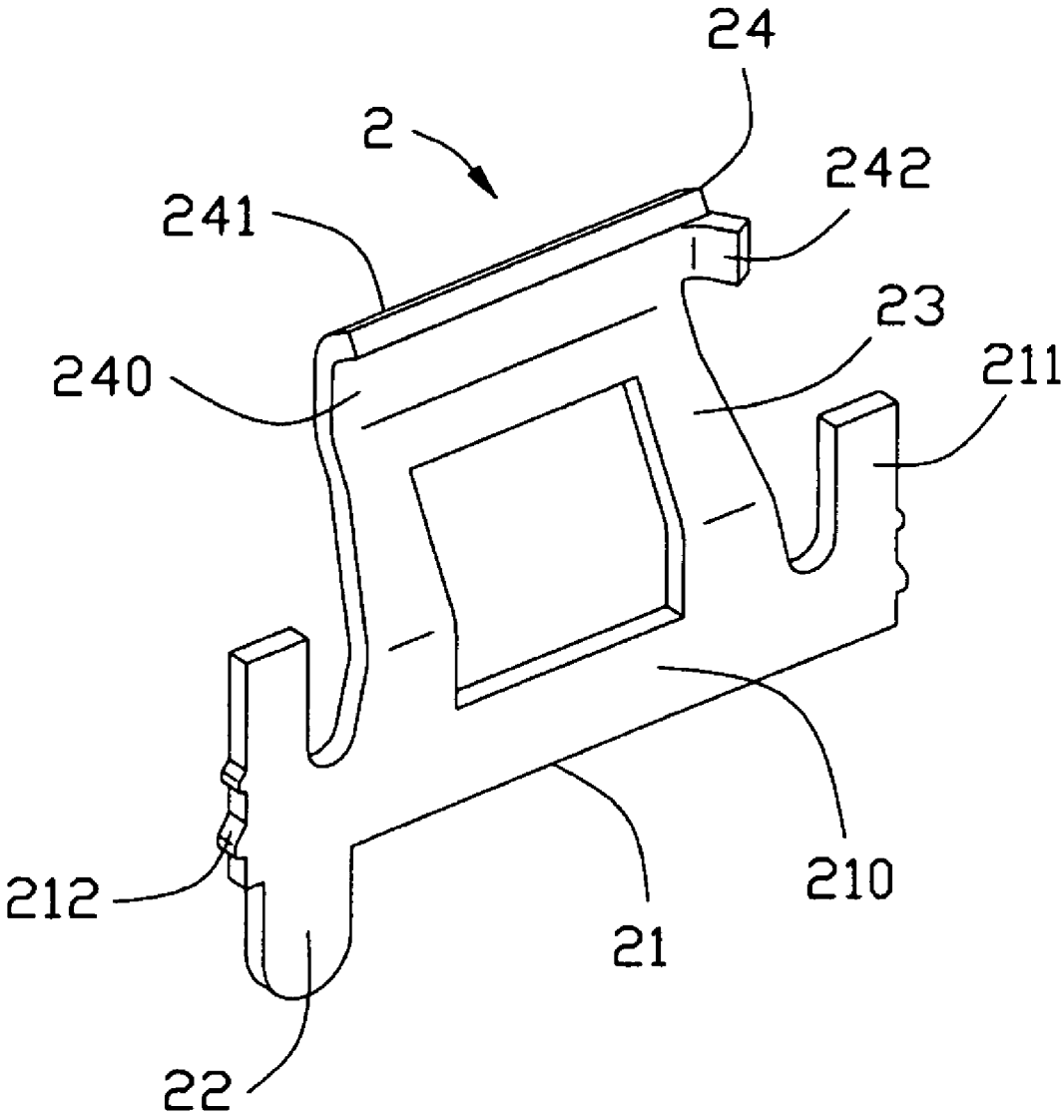
FIG. 6 is a perspective view of a contact of the battery connector shown in FIG. 1.

Each cavity 11, in FIG. 5, comprises a first portion 102 and a second portion 101 communicated with the first portion 102. The first portion 102 is opening to a top face 17 and a side face 18 of the insulative housing 1 for receiving the complementary connector from different directions. The second portion 101 is defined in one side of each spacer 10 formed between each two adjacent cavities 11, and opening to a bottom face 19 of the insulative housing 1 that is used to insert the contacts 2 into in assembly. The contact 2 (shown in FIG. 2) received in the cavity 11 is stamped by a metal piece and in a plate-shape, and comprises a mounting base 21, one elastic section 23 connected integrally with the mounting base 21 and a plate-shaped contact section 24 extending upwardly from the elastic section 23. The mounting base 21, in a plate shape, is parallel to the contact section 24 and received in the second portion 101 of the cavity 11 to engage with the insulative housing 1. The elastic section 23 is slant from the second portion 101 to the first portion 102 of the cavity 11. The plate-shaped contact section 24 of such contact 2 can provide a large plate engagement area 240 to a mating contact (not shown) of the complementary connector, and is exposed in the first portion 102 of the cavity 11 for mating with the mating contact. Furthermore, the contact section 24 can provide a sufficient retention force to the mating contact by the large plate engagement area 240 thereof.

The mounting base 21, shown in FIGS. 5 and 2, abuts against the sidewall of the spacer 10 where the second portion 101 is defined. A pair of holding portions 211 extend upwardly from two opposite sides of the mounting base 21, so as to interferentially engage to the spacer 10 and a bottom wall 14 of the insulative housing 1. Each holding portion 211 has at least one protrusion 212 to reinforce the engagement between the contact 2 and the insulative housing 1. A tail portion 22 extending downwardly from the mounting base 21 is soldered to the circuit board for transmitting the electrical signal of the contact 2.

The elastic section 23 comprises a vertical portion 231 connected perpendicularly to the mounting base 21, and a slant portion 232 extending obliquely from the second portion 101 to the first portion 102. The elastic section 23 defines at least one inner opening (not labeled) therein (in this embodiment, the number of the opening is one), and has at least one subsection (not labeled) formed at one side of the opening. The number of the subsection is adapted to accommodate the requirement of elastic force of the complementary connector. The opening has a changeable size to adapt the elastic force of the elastic section 232.

A curved guiding lip 241 (shown in FIG. 2) extends upwardly and obliquely from one free end of the contact section 24, so that a complementary connector is guided into from the top face 17 of the insulative housing 1. Another curved guiding lip 242 extends sidewardly and obliquely from the contact section 240 to guide the complementary connector into from a side face 18. The two guiding lips 241, 242 have two tips (not labeled) respectively, and the tips are tucked inside the second portion 101 of each cavity 11 to protect the tips from damage. The another guiding lip 242, is perpendicularly to the guiding lip 242, or has an changeable angle, which is smaller than 90 degrees, to the guiding lip 241. So that the complementary connector can be inserted into along the guiding lip 242 in a different direction. A cutout 243 is formed between the two guiding lips 241, 242, this structure is to simple the process of bending the two guiding lips 241, 242.

Figure 3:
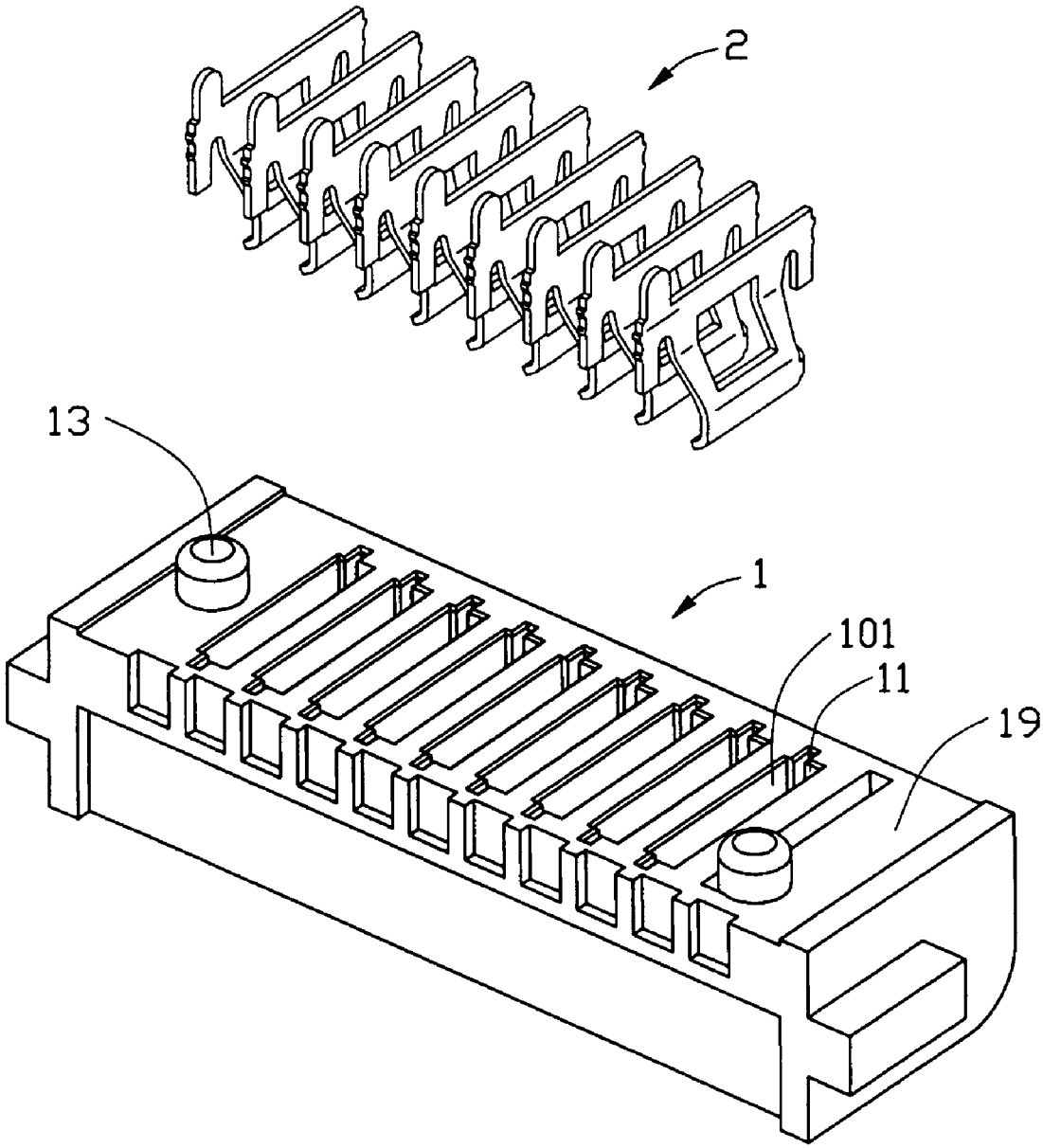
FIG. 3 is an overturned perspective view of the battery connector shown in FIG. 2.
Figure 4:
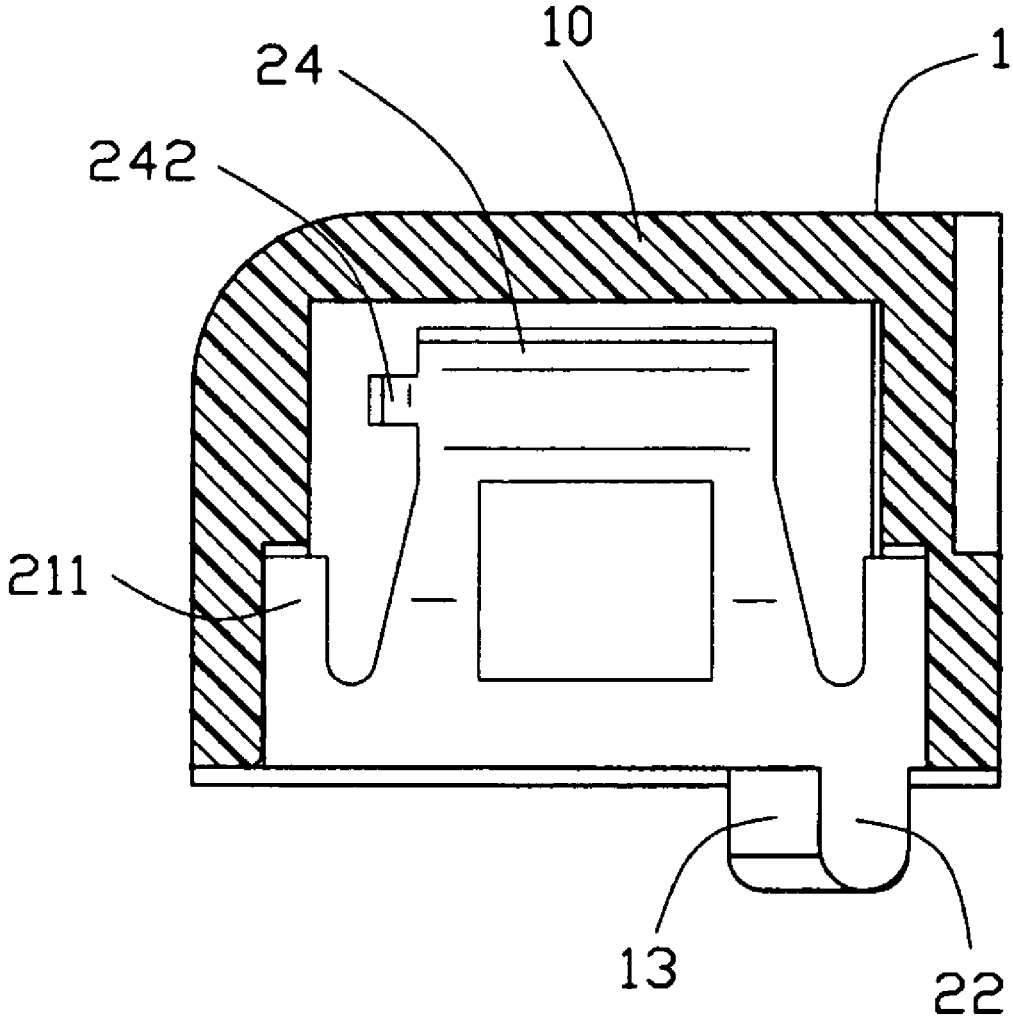
FIG. 4 is a cross-section view of the battery connector taken along line 4—4 of FIG. 1.

In use, the battery connector according to the present invention is mounted to a circuit board (not shown). Two dissymmetric posts 13 (shown in FIG. 3) formed in the bottom face 19 of the insulative housing 1 is used for positioning the battery connector to the circuit board.

Although the present invention has been described with reference to the preferred embodiment, it is apparent to those skilled in the art that a variety of modifications and changes may be made without departing from the scope of present invention which is intended to be defined by the appended claims.

We claim:

1. A battery connector comprising:

an insulative housing extending lengthwise, and defined a plurality of cavities, the cavities at a specific pitch along the length of the insulative housing, and opening toward to a side, top and bottom face of the insulative housing for inserting into a complementary connector from the top and side face;

a plurality of contacts positioned and retained in the corresponding cavities of the insulative housing respectively, each contact stamped by a metal piece, and comprising a flat-plate mounting base engaged with the insulative housing, a resilient section extending obliquely and upwardly from the flat-plate base, a flat-plate contacting section extending from the resilient section and parallel to the base, a curved guiding lip extending from the contacting section for guiding the complementary connector into the battery connector, and a tail section extending downwardly from the mounting base to mount to a circuit board;

wherein the contacting section has another isolated curved guiding lip extending therefrom for guiding the complementary connector along another mating direction;

wherein the another curved guiding lip has a tip tucked in the second portion of the cavity.

2. The battery connector in accordance with the claim 1, wherein the resilient section defined at least one inner opening therein to adapt the elastic of the resilient section.

3. The battery connector in accordance with claim 1, wherein each cavity comprises a first portion opening to the top and side surface, and a second portion defined in an inner wall of a spacer formed between each two adjacent cavities and communicated with the first portion and opening to the bottom face, the mounting base is received in the second portion of the cavity and engaged with a bottom wall of the insulative housing and the inner wall of the spacer, the resilient section is slant from the second portion to the first portion, and the contacting section is exposed in the first portion for mating with a mating contact of the complementary connector.

4. The battery connector in accordance with claim 1, wherein the curved guiding lip has a tip tucked into the second portion of the cavity.

5. The battery connector in accordance with claim 1, wherein the mounting base comprises a two holding portions extending from two ends thereof and opposite to the tail section for interferential engagement with the bottom wall of the insulative housing and the inner wall of the cavity.

6. The battery connector in accordance with claim 5, wherein the holding portion has at least one protrusion to enhance the engagement between the contact and the insulative housing.

7. The battery connector in accordance with claim 1, wherein the insulative housing has two dissymmetric posts formed in the bottom face for positioning the battery connector to a circuit board.

8. The battery connector in accordance with claim 1, wherein the insulave housing has a plurality of spacers formed between each two cavities, and the mounting base abuts against one sidewall of the spacer.

9. A battery connector comprising:

an insulative housing extending lengthwise, and defined a plurality of cavities, the cavities at a specific pitch along the length of the insulative housing, and being open toward to a side, top and bottom face of the insulative housing for inserting into a complementary connector from the top and side face, each of said cavities segregated from the neighboring one by a corresponding spacer, each of the cavities including joined first and second portions wherein the first portion is open to at least both said top and side faces of the housing while said second portion is only open to the bottom face;

a plurality of contacts positioned and retained in the corresponding cavities of the insulative housing respectively, each contact including a retaining portion received in the second portion of the corresponding cavity, a resilient section extending from the retaining portion with a contacting section into the first portion of the cavity, vertical and horizontal curved guiding lips extending from the contacting section in both vertical and horizontal directions corresponding to the top and side faces for guiding the complementary connector into the battery connector;

wherein tips of both said vertical and horizontal curved guiding lips are located in the second portion of the corresponding cavity.

10. The battery connector as claimed in claim 9, wherein the vertical curved guiding lip is wider than the horizontal guiding lip.

* * * * *